US005871035A

United States Patent [19]

Kramer et al.

[11] Patent Number: 5,871,035

[45] Date of Patent: Feb. 16, 1999

[54] HEDDLE FRAME ASSEMBLY WITH IMPROVED HEDDLE SUPPORT RODS

[75] Inventors: Charles F. Kramer, Greenville; James E. Howard, Travelers Rest, both of S.C.

[73] Assignee: Steel Heddle Manufacturing Company, Greenville, S.C.

[21] Appl. No.: 922,609

[22] Filed: Sep. 3, 1997

[51] Int. Cl.[6] ..... D03C 9/06

[52] U.S. Cl. ..... 139/92

[58] Field of Search ..... 139/92

[56] References Cited

U.S. PATENT DOCUMENTS

| | | | |
|---|---|---|---|
| 3,362,437 | 1/1968 | Kramer | 139/92 |
| 3,417,788 | 12/1968 | Kramer | 139/92 |
| 4,503,890 | 3/1985 | Kramer | 139/92 |

OTHER PUBLICATIONS

Advertising Brochure, Steel Heddle Manufacturing Company, Undated.

*Primary Examiner*—Andy Falik

*Attorney, Agent, or Firm*—Dority & Manning, P.A.

[57] ABSTRACT

A heddle support rod for use in a heddle frame includes a first vertical segment along one of the longitudinal edges of the rod. The first vertical segment defines a first vertical front face. A second vertical segment is disposed along an opposite longitudinal edge of the support rod and defines a second vertical face. The first and second vertical faces are essentially parallel and laterally off-set a predetermined distance so that an attaching device, such as a rivet, can attach the support rod to the heddle frame assembly in the area of the second vertical segment. The offset distance is provided so that the protruding head of the attaching device or rivet is not more than flush with the front face of the first vertical segment that engages within a rod slot of a conventional J-type heddle.

18 Claims, 4 Drawing Sheets

HEDDLE FRAME ASSEMBLY WITH IMPROVED HEDDLE SUPPORT RODS

BACKGROUND OF THE INVENTION

The present invention relates to a heddle frame assembly, and particularly to an assembly having improved heddle support rods.

With conventional heddle frame assemblies, and in particular heddle frame assemblies for heddles with J-shaped rodslots, the heddle support rods are attached to the frame slats at various locations along the length of the heddle support rods. For example, in one well-known type of frame assembly, the heddle support rods are attached directly to an extruded frame slat at a number of locations along the length of the support rod. Typically, the support rod is riveted to the frame slat. In another well-known type of heddle frame assembly, the support rods are supported on the slats with a rod support brace carried by or mounted on the slat. These rod support braces are spaced along the slats according to the weaving loads and located internal to the slats and external to the rods. Again, the heddle support rods are typically riveted or screwed to the rod support braces.

With the conventional designs, it is necessary to countersink the rivet or screw holes punched along the length of the heddle support rods so that the head of the rivets or other conventional attaching devices are flush with the front face of the support rods. The heads must be flush with the front face so that the heddle rod slots will have an unimpeded passage along the heddle support rods.

The process of countersinking the rivet holes in the heddle support rods is difficult and time consuming. The spring temper hardness of the heddle support rods makes it extremely difficult to cut the countersinks uniformly because the support rods continuously dull the edges of the cutting tool relatively quickly.

The industry is continuously seeking ways to improve on heddle frame assemblies, particularly by improving on the dependability and security of the frame components. The present invention provides an improved heddle support rod that eliminates the problems noted above with respect to conventional heddle support rods while providing reduced weight and a more secure and dependable rivet system.

OBJECTS AND SUMMARY OF THE INVENTION

The principal object of the present invention is to provide an improved heddle frame assembly incorporating a uniquely designed heddle support rod.

And still a further object of the present invention is to provide an improved heddle support rod for a heddle frame assembly.

Additional objects and advantages of the invention will be set forth in part in the following description, or may, be obvious from the description, or may be learned through practice of the invention.

In accordance with the objects and purposes of the invention, a heddle support rod is provided for use in a heddle frame assembly wherein two of the support rods are spaced apart lengthwise on the heddle frame to support heddles therebetween, as is commonly known in the art. The support rods are supported lengthwise on the heddle frame by way of attaching devices which extend through the support rod and into the heddle frame assembly either directly or indirectly. Each of the support rods includes a length and lengthwise edges with an essentially uniform cross-sectional profile along the length. The support rod includes a first vertical segment along one of the edges. The first vertical segment has a first thickness and a first flat vertical front face configured for sliding engagement with the inside of the heddle rod slot. The rod includes a second vertical segment along an opposite edge of the rod which has a second thickness and a second flat vertical front face. The first and second flat vertical faces are essentially parallel and are laterally offset a predetermined distance. The second vertical segment constitutes that part of the support rod to be connected to the heddle frame slat by an attaching device, such as a screw or rivet, which extends through the second vertical segment and into the heddle frame component.

The attaching device typically has a protruding head. The predetermined offset distance between the first and second flat vertical faces is great enough so that the protruding head of the attaching device is not more than flush with the first vertical flat face. In this regard, an essentially uniform vertical face is presented to the heddle rod slot. This uniform vertical face comprises the first flat vertical front face and the protruding head of the attaching device extending through the second vertical segment. So long as the head does not extend laterally beyond the first vertical segment, it cannot impose any impendence to travel of the heddle along the support rod.

In a preferred embodiment, the first and second vertical segments have a thickness which is essentially the same. In this embodiment, the support rod is essentially bent to form a shoulder separating the first and second vertical segments. The support rod can be formed initially with bend or shoulder, or the bend can be formed in a flat blank member by conventional forming means.

As commonly understood in the art, the first vertical segment includes a lip having a thickness greater than the remaining thickness of the support rod. This lip defines a supporting and guiding ridge for heddles attached to the support rod, particularly heddles with J-shaped rodslots. In a preferred embodiment, the lip is formed as a solid integral member. However, in an alternative embodiment, the lip can be formed from two contiguous members. In this embodiment, the lip may be formed by simply folding over a portion of the first vertical segment.

The unique profile of the heddle support rod according to the invention defines an essentially U-shaped channel on the back face of the support rod.

The present invention also includes a heddle frame assembly incorporating the uniquely designed heddle support rod discussed above.

DETAILED DESCRIPTION OF THE PREFERRED EMBODIMENTS

Figure 1:
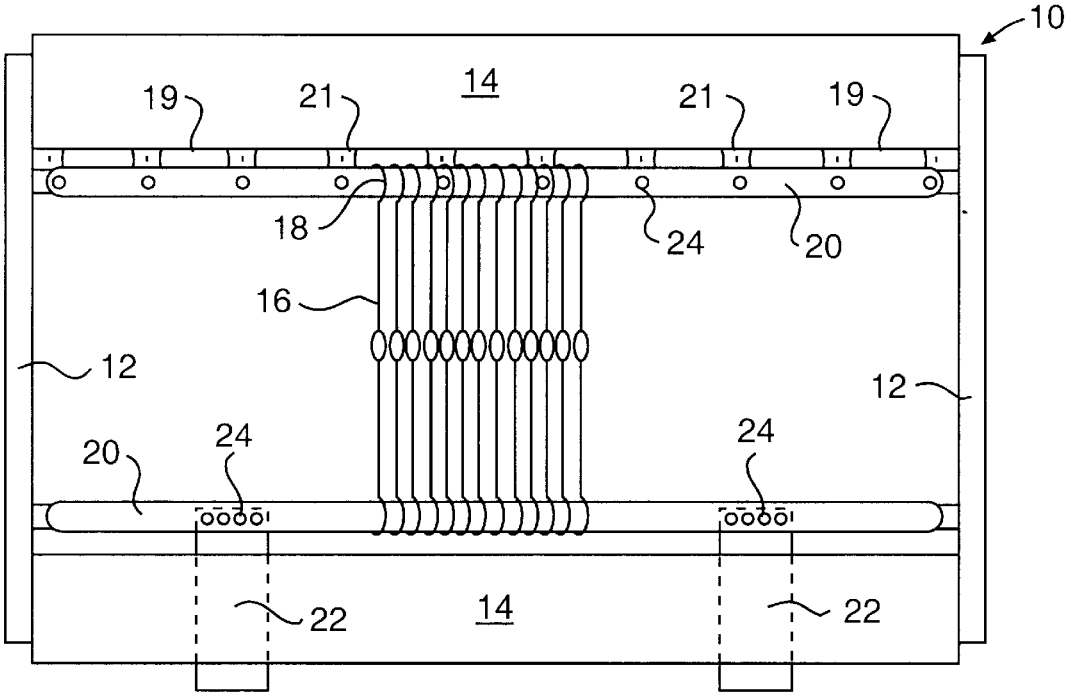
FIG. 1 is an overall view of a heddle frame assembly.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment may be used on another embodiment to yield still a further embodiment. The present application covers such modifications and variations as come within the scope and spirit of the invention.

FIG. 1 illustrates a conventional heddle frame assembly. Such heddle frame assemblies are well known to those skilled in the art and a detailed explanation thereof is not necessary for purposes of the present disclosure. In general, however, heddle frame assembly 10 comprises two end braces 12 connected to horizontal slat members 14. The slats are preferably extruded from a lightweight aluminum or composite material. Heddle frame assembly 10 includes heddle support rods 20 supported lengthwise on the heddle frame by attachment to flats 14. As is commonly understood in the art, heddles 16 are supported on support rods 20. Rod slots 18 of heddle 16 engage on the support rods 20, as more closely seen in FIGS. 2 and 3.

Rod supports 20 are attached to slats 14 in a variety of ways. FIG. 1 illustrates two such ways. On the top slat 14 indicated in FIG. 1, support rod 20 is riveted or otherwise attached directly to portions of the slat 14. In this embodiment, cutouts 19 are provided along the slat between connecting or extending portions 21 to reduce the overall weight of the slat. The bottom rod support 20 illustrated in FIG. 1 is attached indirectly to slat 14 by way of conventional support braces 22. Support braces 22 are connected either internally (as shown) or externally on slat 14, as indicated in FIG. 1. Support braces 22 are riveted or otherwise attached to heddle support rod 20 by way of conventional rivet devices 24.

Figure 3:
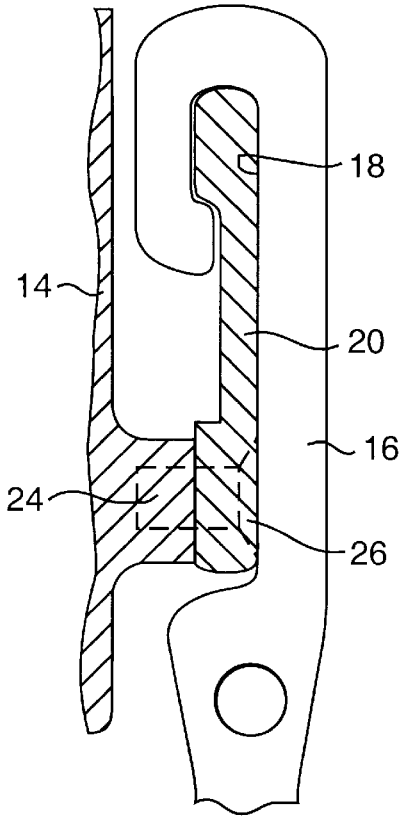
FIG. 3 PRIOR ART
FIG. 3 is an illustration of a prior art heddle frame assembly and prior art heddle support rod.
Figure 2:
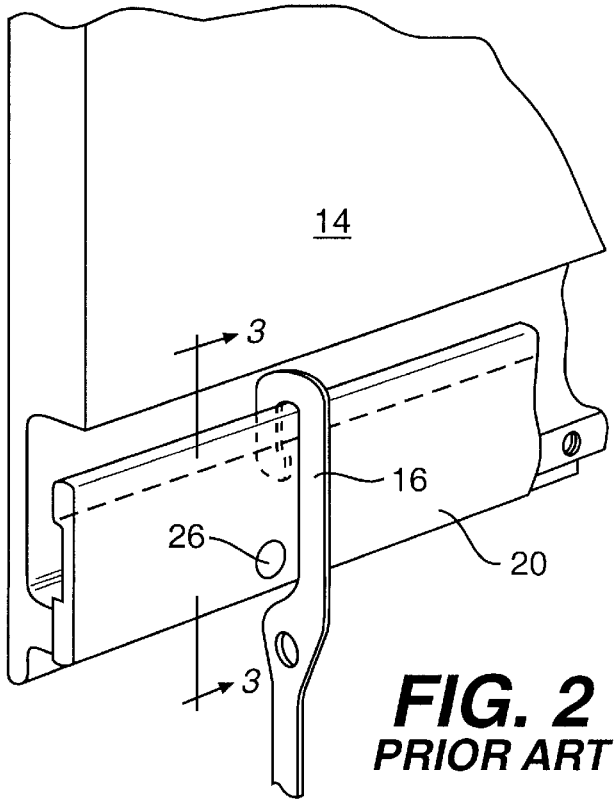
FIG. 2 PRIOR ART
FIG. 2 is an illustration of a prior art heddle frame assembly and prior art heddle support rod.

With the conventional prior art devices as illustrated in FIGS. 2 and 3, support rods 20 are conventionally riveted to slat 14 or support braces 22. However, with these conventional support rods, the rod has a straight vertical face between the edges and it is necessary to define a countersunk hole for the rivet head 26 of the attaching rivet 24, as particularly seen in FIG. 3. It is essential that the countersunk hole is defined so that the rivet head does not protrude beyond the front face of support rod 20 since, as can be particularly seen in FIG. 3, the front face of the support rod is in sliding engagement within the rod slot 18 of heddle 16. As described above, the process of forming the countersunk hole is tedious, time consuming, and expensive.

The figures illustrate the rod slot as being used with J-type rod slots, as commonly known in the art. The J-type heddles are relevant since, with this type of heddle, support rod 20 is attached to slat 14 or brace 22 generally near the end thereof so that a substantial portion of support rod 20 extends into the J-shaped rod slot 18, as particularly seen in FIG. 3.

Figure 4:
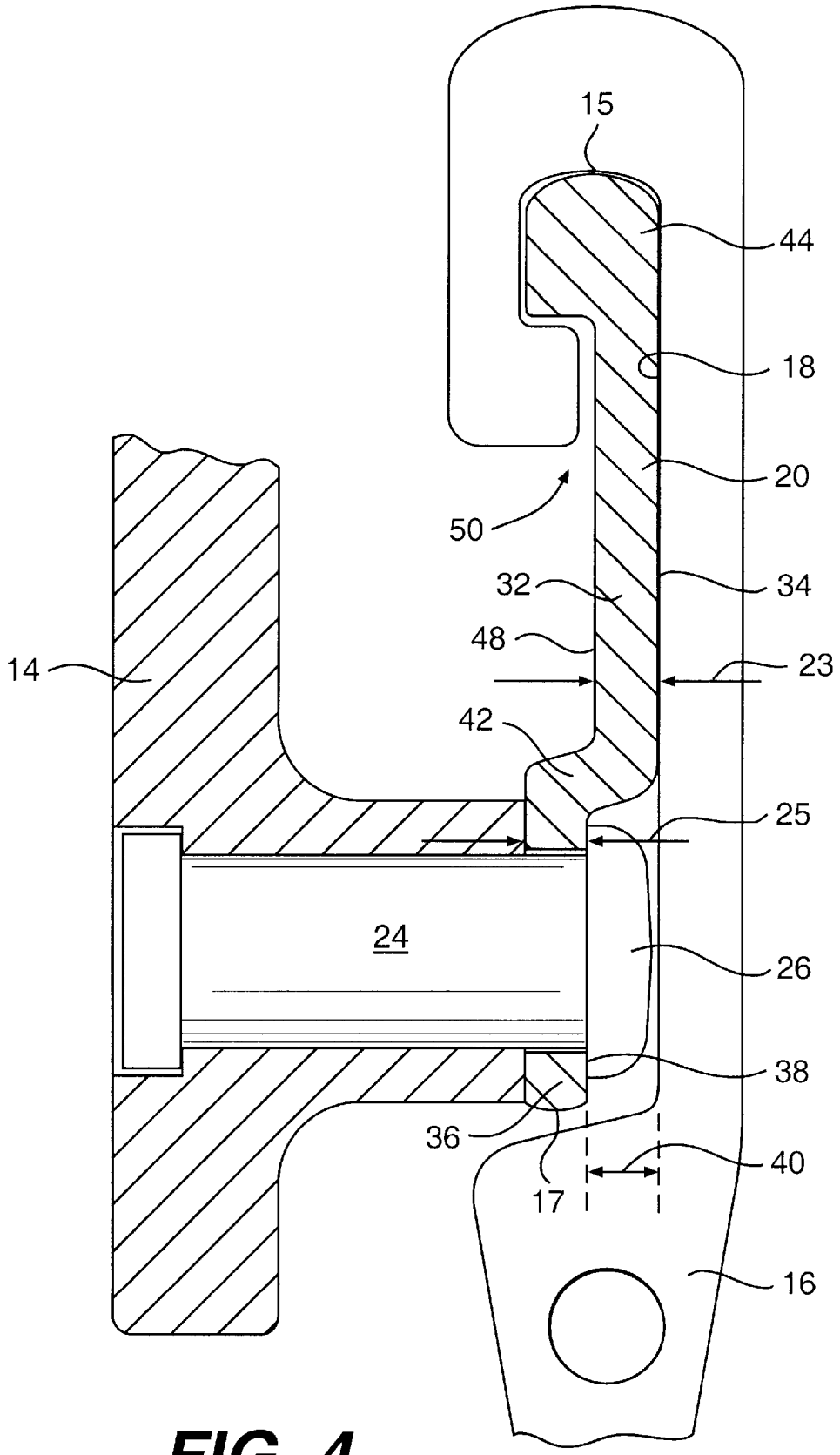
FIG. 4 is a cross-sectional view of a heddle support rod according to the present invention.
Figure 5:
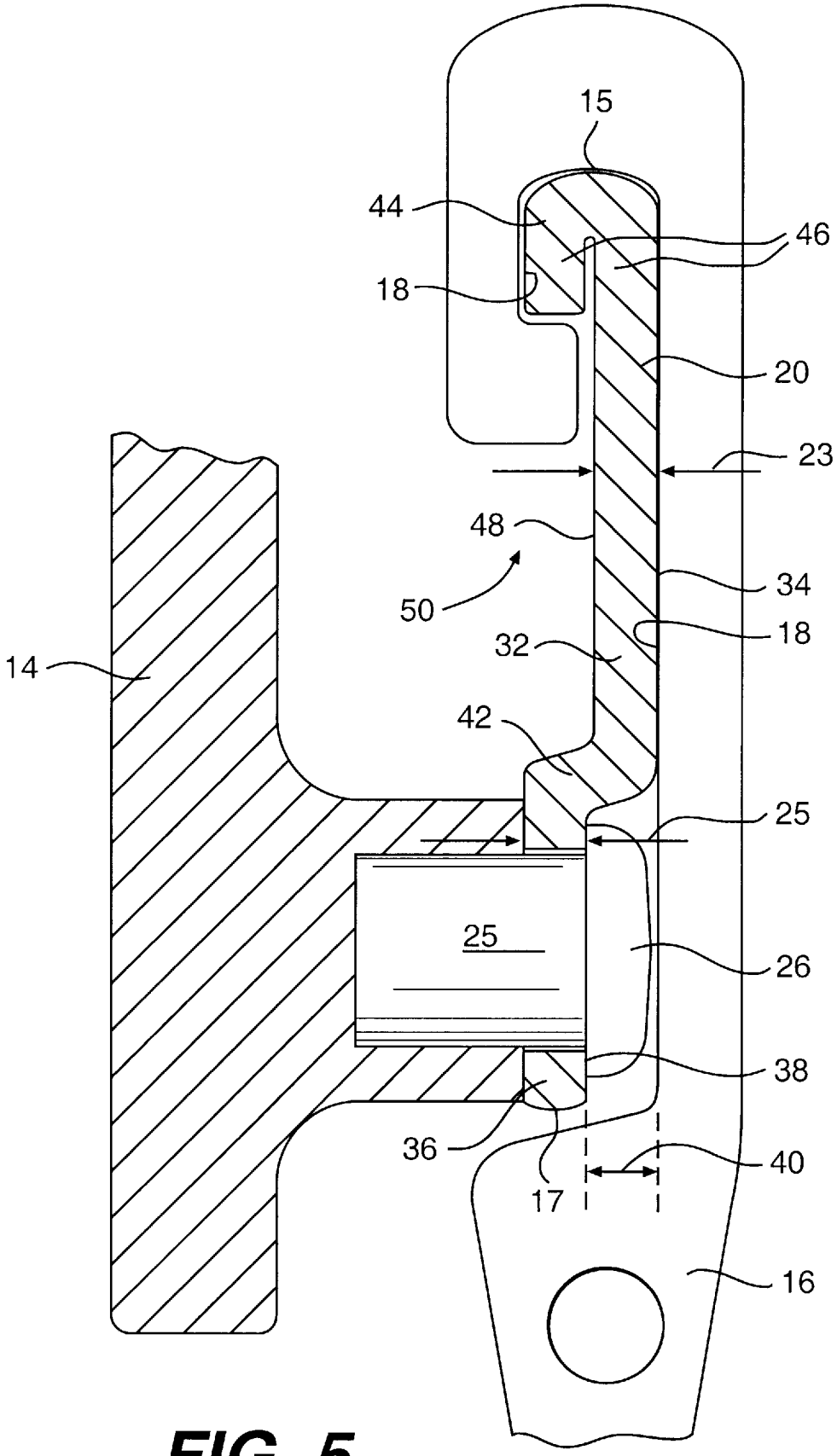
FIGS. 5 and 6 are cross-sectional views of an alternative embodiment of a heddle support rod according to the invention.

FIGS. 4 and 5 illustrate the present inventive support rod 20 for use in a heddle frame assembly wherein support rods 20 are spaced apart lengthwise on heddle frame 10 to support heddles 16 thereon, as generally shown in FIG. 1. Support rods 20 are attached to heddle frame 10 by way of conventional attaching devices extending through support rods 20 and into a component of heddle frame assembly 10, for example slat 14 or support brace 22. Rods 20 are typically connected by way of conventional attaching devices, such as rivets 24 having extending rivet heads 26 as particularly seen in FIG. 4, or bolts 25 as seen in FIG. 5. However, it should be understood that other conventional attaching devices could also be used, such as machine screws, etc.

Support rods 20 have a length and lengthwise edges 15, 17, with lengthwise edge 15 facing the outside of heddle frame assembly 10. Lengthwise edge 17 faces opposite and is adjacent the portion of support rod 20 attached to the heddle frame assembly.

Support rods 20 according to the invention have an essentially uniform cross-sectional profile along their entire length. For example, referring to FIGS. 4 and 5, the unique profile of support rods 20 is uniform along the entire length of the rod from the left-hand end brace 12 to the right-hand end brace 12, as shown generally in FIG. 1.

Each support rod 20 includes a first vertical segment 32 along the lengthwise edge 15. This first vertical segment has a first thickness 23 and a first vertical front face 34 which resides within the J-channel of heddle 16 and is in sliding engagement with the inside face of heddle rod slot 18.

Support rod 20 includes a second vertical segment 36 adjacent the opposite edge 17. Second vertical segment 36 has a second thickness 25 and a second vertical front face 38. First vertical front face 34 of the first vertical segment and second vertical front face 38 of the second vertical segment are parallel and laterally off-set a distance indicated as 40 in FIGS. 4 and 5. This lateral off-set distance is at least great enough so that the head 26 of the attaching device is at least flush with first vertical front face 34, as particularly shown in FIGS. 4 and 5. It may be preferred that head 26 is essentially flush in the vertical sense with front face 34 so that head 26 also acts as a bearing and support component for heddle 16. However, it should be understood, that it is within the scope and spirit of the invention that the off-set distance 40 be so great that the front face of head 26 is "below", or to the left as seen in FIGS. 4 and 5, of front face 34 of first vertical segment 32.

In a preferred embodiment as illustrated in the figures, the thicknesses 23 of first vertical segment 32 and 25 of second vertical segment 36 are essentially the same. In this embodiment, it is a relatively simple procedure to form support rod 20 by bending or otherwise forming a shoulder 42 in an essentially blank piece of metal. However, it should be appreciated that the profile of support rod 20 can be formed by any conventional manner, such as extruding, grinding, rolling, etc. The exact procedure for forming the profile is not critical to the invention.

Figure 6:
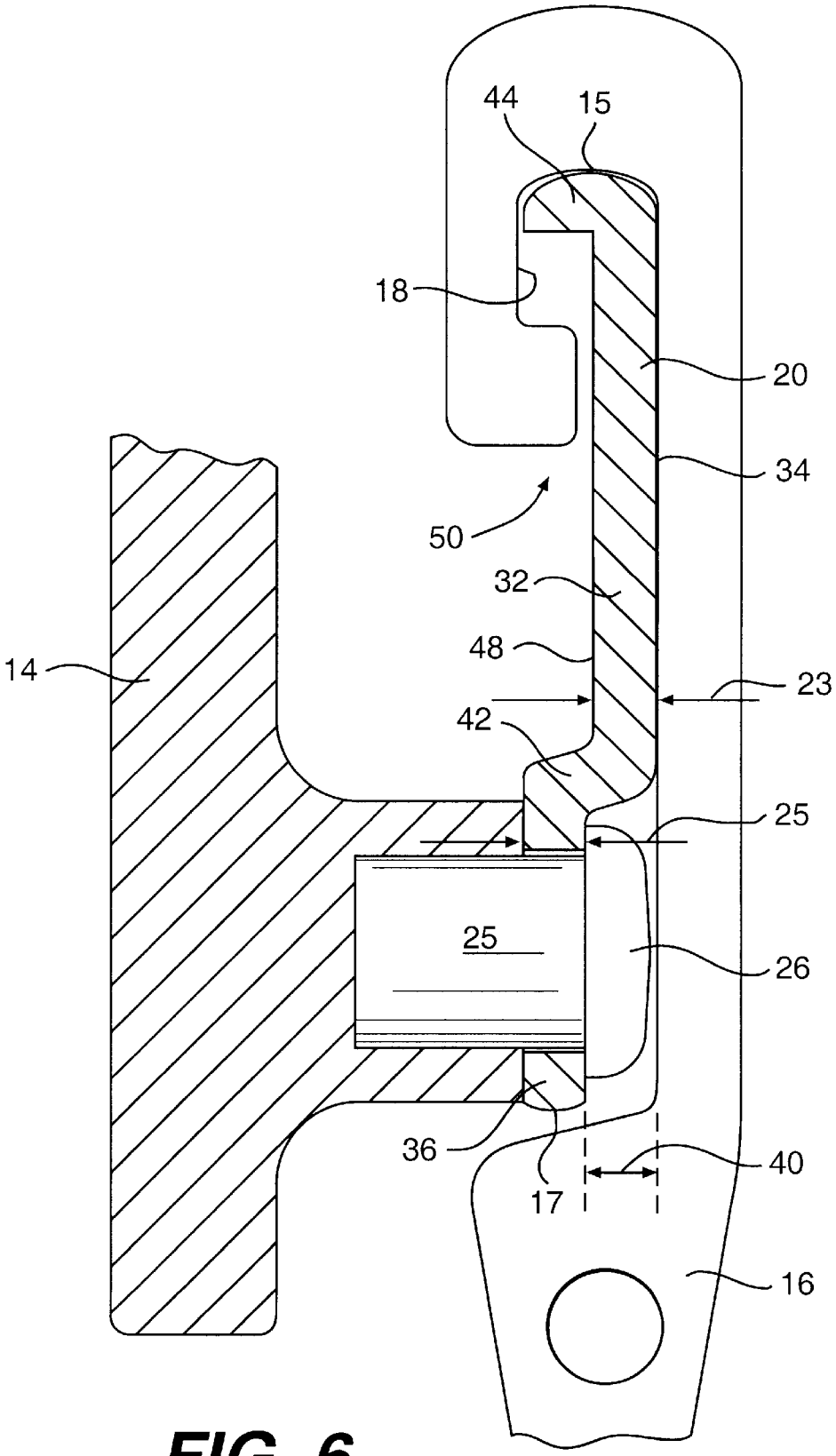

Support rod 20 also includes a lip section generally along longitudinal edge 15 which has a thickness greater than first thickness 23 of the first vertical segment 32, as particularly seen in FIGS. 4, 5, and 6. This lip can be formed in various manners. For example, as illustrated in FIG. 4 the lip 44 may comprise a solid integral component. The embodiment illustrated in FIG. 5 shows lip 44 formed from two contiguous members 46. In this embodiment, the lip is formed by bending over a portion of first vertical segment 32. FIG. 6 illustrates an embodiment wherein lip 44 is formed by bending a portion of the first vertical segment ninety degrees. As well understood by those skilled in the art, the lip cooperates with rod slot 18 defined in conventional J-channel heddles.

As seen in FIGS. 4 and 5, support rod 20 formed according to the present invention defines essentially a U-shaped channel 50 defined on a back face 48 of the support rod. Channel 50 is defined at one end by lip 44 and at the other end by shoulder 42.

The front faces 34, 38 of vertical segments 32, 36 respectively are illustrated in the figures as being essentially flat. It should be understood, however, that these vertical faces may also comprise a textured or nonflat surface. For example, it may be preferred that front face 34 actually comprise a pattern of radial protrusions to limit the surface area contact, and thus friction, with rod slot 18 of heddle 16. Any and all such configurations of the vertical faces are within the scope and spirit of the invention.

It should be appreciated by those skilled in that art that various modifications and variations can be made in the present invention without departing from the scope and spirit of the invention. It is intended that the present application cover such modifications and variations as come within the scope of the appended claims and their equivalents.

What is claimed is:

1. A heddle support rod for use in a heddle frame assembly wherein two of said support rods are spaced apart lengthwise on the heddle frame and support J-channel heddles therebetween, said support rod supported lengthwise on the heddle frame assembly by way of attaching devices extending through said support rod and into the heddle frame assembly, said support rod comprising:

a length and lengthwise edges so as to extend across a heddle frame assembly, and an essentially uniform cross-sectional profile along said length;

a first vertical segment along one of said edges, said first vertical segment having a first thickness and a first vertical front face for sliding engagement with a heddle;

a second vertical segment along an opposite said edge and having a second thickness and a second vertical front face;

said first and second vertical faces being essentially parallel and laterally offset a predetermined offset distance; and wherein said second vertical segment is configured to be connected to a component of a heddle frame by an attaching device having a head extending through said second vertical segment into the heddle frame component, said predetermined offset distance being great enough so that the head of the attaching device is not more than flush with said first vertical flat face.

2. The heddle support rod as in claim 1, wherein said first and second thicknesses of said first and second vertical segments respectively are essentially the same.

3. The heddle support rod as in claim 2, wherein a shoulder separates said first and second vertical segments.

4. The heddle support rod as in claim 1, wherein said first vertical segment comprises a lip having a thickness greater than said first thickness, said lip defining a supporting and guiding ridge for heddles attached to said support rod.

5. The heddle support rod as in claim 4, wherein said lip is formed as a solid member.

6. The heddle support rod as in claim 4, wherein said lip is formed from two contiguous members.

7. The heddle support rod as in claim 6, wherein said lip is formed from a folded over section of said first vertical segment.

8. The heddle support rod as in claim 6, wherein said first vertical segment comprises a back face defining an essentially U-shaped channel.

9. The heddle support rod as in claim 1, wherein said first and second vertical front faces are essentially flat.

10. A heddle frame assembly comprising:

end braces, and a pair of laterally extending slats connected to said end braces to form a generally rectangular frame;

a heddle support rod associated with each of said slats and extending parallel thereto for carrying J-channel heddles, said support rods connected to respective said slats at least one position along their length, each said support rod comprising a length and inside and outside lengthwise edges, and an essentially uniform cross-sectional profile along said length;

a first vertical segment along said outside edge, said first vertical segment having a first thickness and a first flat vertical front face for sliding engagement with heddles;

a second vertical segment along said inside edge and having a second thickness and a second flat vertical front face, said support rod connected to said slat by attaching devices extending through said second vertical segment into said slat at least one position along said length, said attaching devices having heads;

said first and second flat vertical faces being essentially parallel and laterally offset a predetermined offset distance which is great enough so that said head of said attaching devices are not more than flush with said first vertical flat face.

11. The heddle frame assembly as in claim 10, wherein said heddle support rods are attached directly to said slats at a plurality of positions along said length thereof.

12. The heddle frame assembly as in claim 10, wherein said heddle support rods are attached to support braces connected to said slats.

13. The heddle frame assembly as in claim 10, wherein said first and second thicknesses of said first and second vertical segments of said support rods are essentially the same.

14. The heddle frame assembly as in claim 10, wherein said first vertical segment of said heddle support rods comprises a lip having a thickness greater than said first thickness, said lip defining a supporting and guiding ridge for heddles attached to said support rod.

15. The heddle frame assembly as in claim 14, wherein said lip is formed as a solid member.

16. The heddle frame assembly as in claim 14, wherein said lip is formed from two contiguous members.

17. The heddle frame assembly as in claim 16, wherein said lip is formed from a folded over section of said first vertical segment.

18. The heddle frame assembly as in claim 10, wherein said first vertical segment comprises a back face defining an essentially U-shaped channel.

* * * * *